United States Patent [19]

Clabby, deceased et al.

[11] 4,450,980

[45] May 29, 1984

[54] DISPOSABLE RAZOR DISPENSER

[76] Inventors: Merlyn L. Clabby, deceased, late of Upland, Calif.; Patrick J. Sheppard, executor, 920 8th St., Zephyrhills, Fla. 34248

[21] Appl. No.: 374,491

[22] Filed: May 3, 1982

Related U.S. Application Data

[63] Continuation of Ser. No. 172,454, Jul. 25, 1980, abandoned.

[51] Int. Cl.[3] ..... A47F 1/08; B65D 83/00; B65D 65/32; B65D 71/00

[52] U.S. Cl. ..... 221/281; 206/228; 221/283

[58] Field of Search ..... 221/281, 282, 197, 283; 211/49 D; 206/228, 349, 352, 356; 312/42; 248/224.3, 224.4; 220/76–78; 222/181

[56] References Cited

U.S. PATENT DOCUMENTS

| | | | |
|---|---|---|---|
| 1,764,673 | 6/1930 | Babson | 221/283 X |
| 2,170,182 | 8/1939 | Anthony | 222/181 |
| 2,530,892 | 11/1950 | Mayo | 248/224.3 X |
| 2,639,960 | 5/1953 | Frederick | 221/283 X |
| 2,922,248 | 1/1960 | Kocsi | 248/224.3 |
| 2,969,140 | 1/1961 | Avetta | 206/349 |
| 4,043,035 | 8/1977 | Pentney | 206/356 X |
| 4,140,244 | 2/1979 | Clabby | 221/281 |
| 4,159,773 | 7/1979 | Losenno | 248/224.3 X |

*Primary Examiner*—David A. Scherbel

*Attorney, Agent, or Firm*—Shoemaker and Mattare, Ltd.

[57] ABSTRACT

An improvement in a dispenser for disposable razors having a housing which is mountable for conveniently storing and dispensing disposable razors includes a tongue for releasably mounting the housing on a backing member which is affixed to a wall. The housing stores a plurality of disposable razors in a stacked configuration with the handles of such disposable razors presented outwardly to be easily grasped and removed from the housing. A ledge is mounted on the housing for storing razors between uses thereof.

5 Claims, 11 Drawing Figures

DISPOSABLE RAZOR DISPENSER

This is a continuation of application Ser. No. 172,454, filed July 25, 1980, now abandoned.

BACKGROUND OF THE INVENTION

The present invention relates, in general, to containers, and, more particularly, to an improvement in dispensers for disposable razors.

The market for shaving equipment has undergone considerable changes in recent times. Devices in that market have developed from the simple razor blades which are disposed of after only a few uses to razor shaving heads which are disposed of after several uses, to an entire razor which is disposed of after several uses. The disposable razor is the most recent development in the shaving equipment market.

While dispensing devices associated with shaving devices have also undergone concomitant changes, from the blade dispenser to the shaving head dispenser, such development has stopped short of the equipment market, in that only one device is available for dispensing the newly developed disposable razors. Thus, while devices such as those disclosed in U.S. Pat. Nos. 4,043,035, 3,970,194 and 3,754,326 are for dispensing shaving heads, that device disclosed in U.S. Pat. No. 2,330,639 for dispensing blades, and that device disclosed in U.S. Pat. No. 3,737,860 for holding a razor, and while those devices are suitable for some purposes, those devices fall short of filling the requirements of convenience in selling, displaying and dispensing disposable razors. These devices are especially deficient in providing a suitable storage arrangement for the disposable razors once a package of such razors has been opened.

While mountings for safety razors are known (see, for example, U.S. Pat. No. 2,969,140), the inventor is aware of only one device which can be mounted in a convenient location which dispenses disposable razors. Thus, there is need for such a device if the dispensing market is to keep pace with the shaving equipment market.

As discussed above, a device for dispensing disposable razors is known and is disclosed in U.S. Pat. No. 4,140,244.

However, while quite efficient, the device disclosed in this patent has proved to be somewhat difficult to manufacture and is not amenable to machine loading. While such device can be mounted in a user's bathroom, it is not readily replaceable as a unit once mounted. Thus, there is need for an improvement in the device disclosed in U.S. Pat. No. 4,140,244.

The device disclosed herein satisfies this need.

SUMMARY OF THE INVENTION

The device embodying the teachings of the present invention stores and dispenses disposable razors in a convenient manner and is an improvement of the device disclosed in U.S. Pat. No. 4,140,244.

The basic dispenser includes a case which isdesigned to be releasably secured to a wall via a hollow backing member which is securely affixed to that wall. For dispensing, the razors are guided down a vertically oriented elongate trackway with the handles thereof protruding from a vertical slot running the length of the storage area and which forms the trackway. Each razor handle overlaps the handle of a subjacent razor to an extent required to minimize the amount of space required for the dispensing device. Each razor has a shaving head which includes a blade section, and such blade sections are positioned in stacked relationship in the dispenser.

Each razor is thus pendently supported and the handle thereof extends downwardly from the dispenser. The weight of the handle exerts a very slight pull on the shaving head against the front and back walls of the case and helps keep the razors in proper alignment in the dispenser. The razors slip down the slot with the handles thereof protruding until they reach a retainer shelf located adjacent the bottom of that slot. The shelf is spaced from the slot to define a dispensing slot, and maintains the razors in a dispensing presentation. Individual razors are then released by pushing each razor sideways, or horizontally, through the dispensing slot. The dispensing slot is sized to permit the razor head to freely slide, yet is only large enough for the handle to slip through. Such sizing keeps the razors from sliding out of the container.

The dispenser can also be used as a part of a promotion for the razors themselves, and therefore actually contributes to the disposable razor market in addition to the above-discussed features.

Accordingly, using the dispensing device herein disclosed, a suitable supply of dispensable razors is always maintained at a convenient location. Furthermore, the device is handy and convenient to use and easily attachable to a wall, such as a bathroom wall. The device is inexpensive to manufacture and therefore can be marketed easily. The device is ideally suited for an injection molding process, thereby further expediting manufacture thereof.

The improved device of the present disclosure includes a removable top or a removable front to facilitate machine loading of the razors. The wall hanger provides a convenient, useful means for replaceably mounting a razor dispenser.

Razors are conveniently stored between uses on the improved dispenser, and this storage means can have a curved portion to center the razor on the dispenser and to prevent water and/or shaving cream from dripping into the dispenser.

The device also includes means to prevent the blades of the razors from contacting the storage compartment. Thus, no protective covers need to be included with the razors themselves.

OBJECT OF THE INVENTION

It is, therefore, an object of the present invention to provide an improved means for storing and dispensing disposable razors.

This, together with other objects and advantages which will become subsequently apparent, resides in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
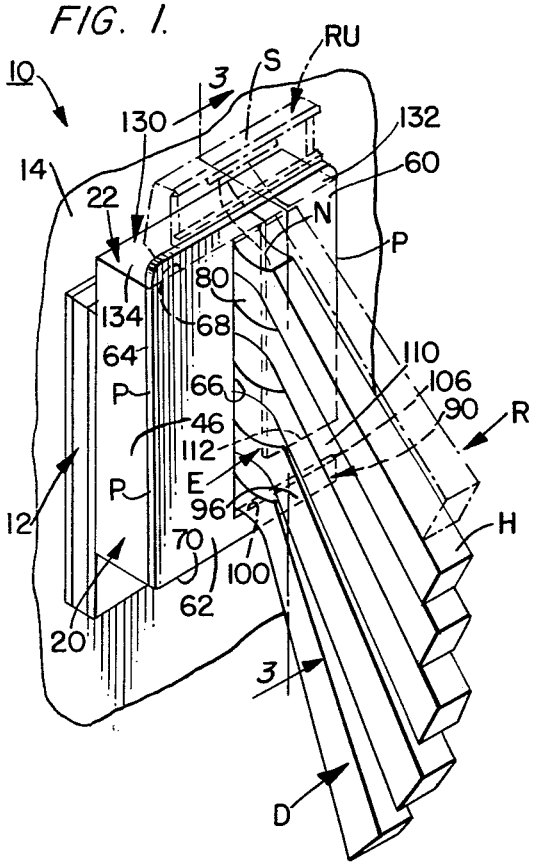
FIG. 1 is a perspective view of one form of the improved disposable razor dispensing device embodying the teachings of the present invention.

Shown in FIG. 1 is a disposable razor display 10 which includes a backing member 12 which is permanently mounted on a wall 14 such as a bathroom wall, or the like.

Figure 2:
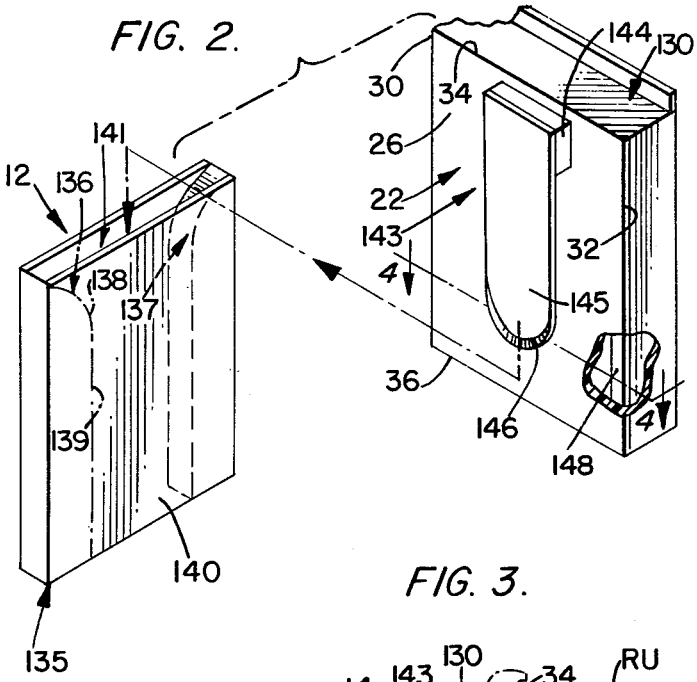
FIG. 2 is an exploded perspective of the improved disposable razor dispensing device embodying the teachings of the present invention.
Figure 3:
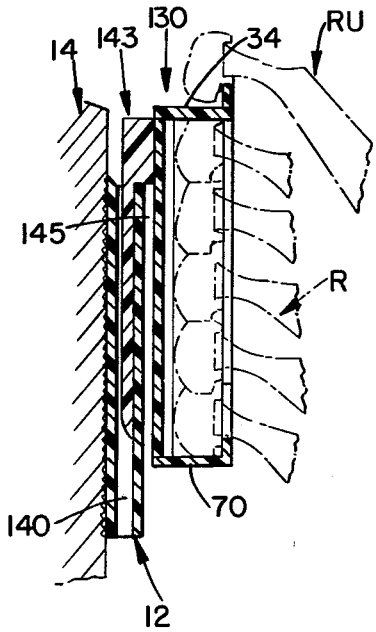
FIG. 3 is a view taken along line 3—3 of FIG. 1.

A disposable razor dispenser 20 embodying the teachings of the present invention is affixed to the backing member and one form of the dispenser is shown in FIGS. 1-4 to include a frame 22 which has an elongate back 26. The back 26 includes longitudinal side edges 30 and 32, end edges 34 and 36 of which edge 34 is shown in FIG. 2 to be the top edge and edge 36 is shown in FIG. 2 to be the bottom edge of the back 26.

A pair of elongate side panels are integrally mounted on the back 26 adjacent the longitudinal side edges thereof. both side panels are identical, and as shown in FIG. 1, side panel 46 is mounted to be perpendicular to the plane of the back.

A pair of spaced, co-planar front members 60 and 62 are each mounted on a corresponding side panel to be in spaced parallelism with the dispenser back 26. As shown in FIG. 1, the front members each has longitudinal side edges 64 and 66, and end edges 68 and 70, of which side edges 68 form top edges and end edges 70 form bottom edges, longitudinal side edges 64 forming outer edges and longitudinal side edges 66 forming inner edges. The longitudinal side edges 66 are spaced apart to define a slot 80 therebetween. As will be discussed below, the slot 80 is elongate and forms a track through which disposable razors are guided.

Still referring to FIG. 1, the dispenser 20 further includes a lower end panel 90. A facing plate 96 is attached to the panel 90 to be in spaced parallelism with the back. The facing plate 96 has a longitudinal edge 100 which forms the top edge of that plate, and an end edge 106 which forms the side edge of the facing plate, and which is aligned with back edge 30. The facing plate defines an elongate dispensing slot 110 with bottom edge 112 of the member 60.

The disposable razors R are stored in the slot 80 in imbricated fashion and each razor includes the usual handle H, neck N and shaving head S. The longitudinal side edges 66 of the front members are horizontally aligned and are spaced apart a distance sufficient to accommodate the razor neck N in a free sliding manner.

Figure 4:
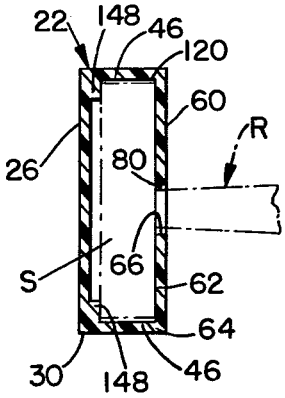
FIG. 4 is a view taken along line 4—4 of FIG. 2.

As shown in FIG. 4, the spaced nature of the frame elements of the dispenser forms a channel 120 which has a transverse width sufficient to receive razor head S in free sliding contact with the inner surfaces of the back 26 and the front members. The channel also has a transverse length greater than the length of the razor head S, thus forming gaps adjacent either end edge of the razor head.

As best shown in FIG. 1, the dispenser 20 includes a ledge 130 having an upstanding flange 132 which is mounted on top edge 134 of the frame 22. This ledge serves as a resting place for a razor which is being used. Such a razor is indicated in FIG. 1 by the reference indicator RU. The razor can be stored on the ledge 130 when not in use.

As best shown in FIG. 2, the backing member 12 includes a hollow frame 135 having a pair of track defining guides 136 and 137. Each guide includes a shoulder 138 and an inner edge 139, with the inner edges 139 being spaced from each other to define a guideway 140. The backing member 12 is securely affixed to a wall as shown in FIG. 1 by gluing or the like, so that entrance slot 141 is located on the top of that mounted backing member.

A hook element 143 includes a mounting element 144 securely affixed to the back 26 and a tongue 145 securely affixed to the element 144 to extend downwardly therefrom toward lower edge 36 of the dispenser. The tongue has a bevelled, arcuate free end 146. As indicated by arrow 147 in FIG. 2, the tongue 145 is received in the guideway 140 to releasably attach the dispenser 20 to the wall via the backing member 12.

Figure 6:
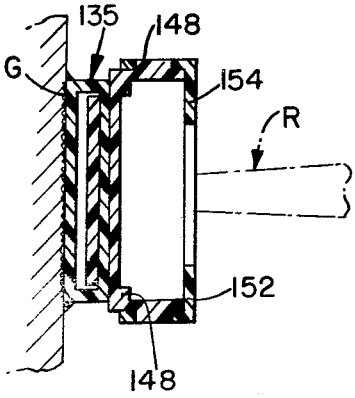
FIG. 6 is a view taken along line 6—6 of FIG. 5.
Figure 7:
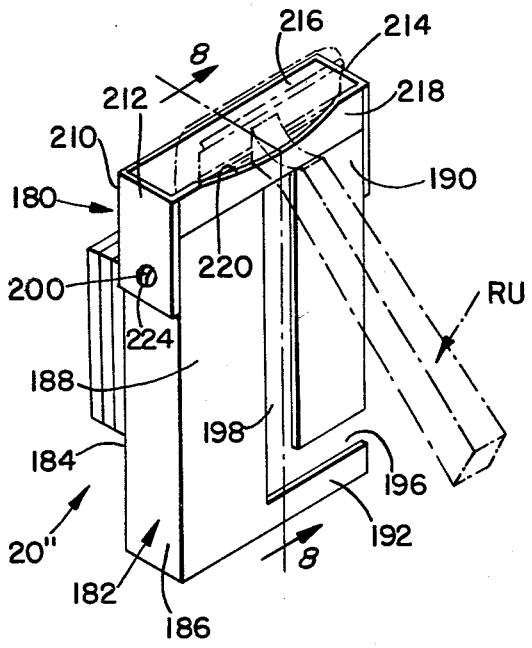
FIG. 7 is a perspective view of another form of the improved disposable razor dispensing device embodying the teachings of the present invention.
Figure 8:
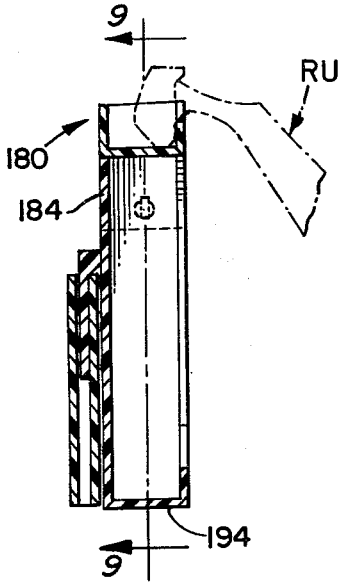
FIG. 8 is a view taken along line 8—8 of FIG. 7.
Figure 9:
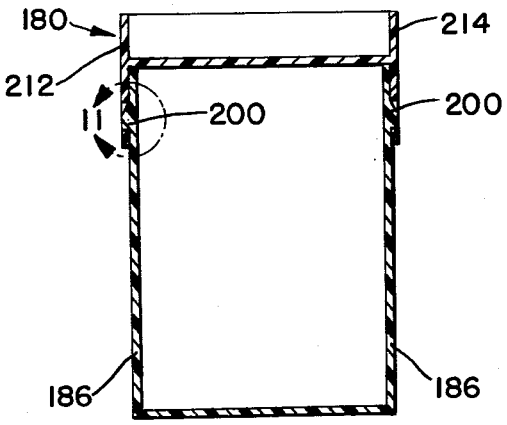
FIG. 9 is a view taken along line 9—9 of FIG. 8.

The tongue 145 is shown in FIG. 2 to have a width of less than the width of the dispenser 20, but can have a width only slightly less than that of the dispenser as shown in FIG. 6. Other sizes and forms of the tongue can be used without departing from the scope of the present disclosure, and the above-disclosed forms are intended to be examples, and not limitations.

The front members 60 and 62 can be affixed to the side panels 46 after the razors have been loaded into the open dispenser. Adhesive or the like can be applied to the panels 46 and the front members mounted thereon to secure the razors in position. Pressure points, such as points P, can be included on each member 60 and 62 in such a case.

Raised rails are located on the back of the razor compartment in such a way as to keep the cutting edge of the razor from contact with the back of that compartment. A rail 148 is best shown in FIG. 2. This arrangement eliminates the need for individual plastic covers over each razor blade. Furthermore, the flange 90 is sized to prevent the razor head from touching the bottom of the compartment, and bottom rails can be located on the inner surface of bottom edge 70 to further prevent the razor head from contacting the bottom of the compartment.

The operation of the dispenser is indicated in FIGS. 1-4. The razors are loaded into the dispenser and moved down the slot 80 toward an exitway E. The width of the dispensing sot slightly exceeds the thickness of the razor necks N so the razors can be moved outwardly from the slot. The dispenser is releasably mounted on the backing member which is securely affixed to a wall 14.

As each razor is removed from the dispensing slot, the other superjacent razors gravitate downwardly to force the next superjacent razor into the dispensing slot in a dispensing position. A razor in such dispensing position is shown in FIG. 1 and indicated by the reference indicator D. The handle of razor D hangs downwardly from the dispensing slot to be in an easily graspsed presentation. During use, or between uses, a razor is stored on the ledge on the top of the dispenser.

As shown in the figures, the razors are supported in an orientation which prevents damage to the blades thereof during the dispensing process. It is noted that the channel 120 is sized to be large enough to allow the razors to slide, yet small enough to eliminate play in the razors which might damage those devices.

Figure 5:
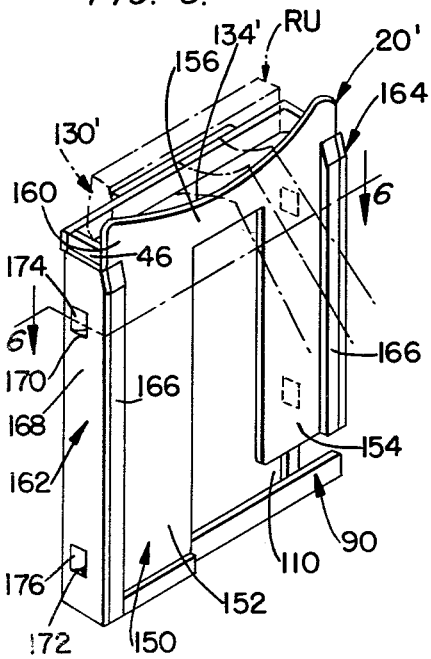
FIG. 5 is a perspective view of another form of the improved disposable razor dispensing device embodying the teachings of the present invention.

An alternative form of the dispenser is shown in FIGS. 5 and 6 and is indicated by reference indicator 20'. The device 20' includes a front member 150 which is unitary and is U-shaped. The front member 150 includes a long leg 152, a short leg 154 and a top cross member 156 integrally connected to the legs 152 and 154. The cross member includes an upper flange 160 which is curved and cooperates with top edge 134' to form ledge 130' as above-discussed. The edge 134' can be sloped toward the back of the dispenser if so desired so that the sides and back of the dispenser form a cage for the stored razor. The short leg 154 has the lower end thereof spaced from the panel 90 to define the dispensing slot 110.

A pair of side members 162 and 164 are securely affixed to the front member 150. Each side member includes a back flange 166 affixed to the member 150 and a side element 168 extending at right angles to the back flange 166. Each side element includes a pair of spaced slots 170 and 172, and each side panel 46 includes a pair of tabs 174 and 176 which are received in the slots so that the front member 150 can be snapped onto the side panels to form dispenser 20' after the razors are loaded into the open dispenser. Once snapped into place, the front member is essentially permanently affixed to the side panels. Adhesive G, or the like, can be used to affix the backing member 135 to a wall.

As shown in FIG. 6, the slot forming members are omitted in the backing member 26' used to mount the dispenser 20' on a wall.

It is noted that the curved form of the ledge can be used on the first-discussed embodiment of the backing member 26 as well, if so desired.

Yet another form of the dispenser is shown in FIGS. 7–11 and is indicated by reference indicator 20''. The dispenser 20'' includes snap-on ledge unit 180 which attaches to a unitary body 182. The body 182 includes a back 184, side panels 186 and front panels 188 and 190, as well as flange 192 and lower edge member 194. The flange is spaced from the panel 190 to define a dispensing slot 196 and the panels 188 and 190 are spaced from each other to define a slot 198 as above-discussed. The top of the dispenser 20'' is opened and razors are loaded into the dispenser 20'' via such open top.

A pair of tabs 200 are mounted on the side panels 186 near the top thereof. A tab is best shown in FIG. 10, and each tab includes a sloped top surface 202, an outer face 204 which is essentially parallel to the panel 186 and a bottom edge 206 which is essentially perpendicular to that side panel.

The ledge unit 180 is integral and includes a back element 210, side elements 212 and 214, cross element 216 and razor mounting flange 218. The cross element is spaced from the top of the unit to define a cage which holds the razor head. The flange includes an arcuate section 220 for securely holding a razor.

Figure 10:
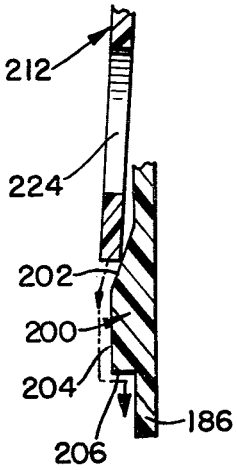
FIG. 10 is a view showing a coupling means of the FIG. 7 embodiment.
Figure 11:
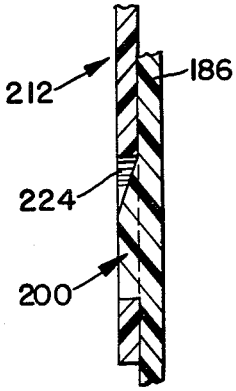
FIG. 11 is a view taken along line 11—11 of FIG. 9.

A pair of holes 224 are defined in the side elements near the bottom thereof to receive the tabs 200 as shown in FIGS. 10 and 11 to effect the snap-on feature of the ledge unit 180. Once the ledge unit 180 is snapped onto the housing, the shape of the tabs 200 prevents inadvertent disengagement of that ledge unit from the housing.

The snap-on unit can be used in conjunction with the other embodiments of the presently disclosed razor dispenser.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

It is claimed is:

1. An improvement in a device for dispensing disposable razors, the device comprising:

a housing having a back, sides and a front, said front having an elongate slot defined therein for slidably accommodating disposable razors in a stacked configuration;

a retainer shelf mounted on said back to be located adjacent said slot, said shelf being positioned to support a disposable razor thereon while such razor is accommodated in said slot;

dispensing slot defining means on said retainer shelf for guiding disposable razors out of said elongate slot and out of said housing;

said housing front, sides and back defining a chamber in which the heads of disposable razors are positioned so that the handles of such disposable razors extend outwardly of said chamber through said elongate slot into an orientation wherein said handles can be grasped for moving a disposable razor through said elongate and dispensing slots;

the improvement comprising:

a mounting means which is securely affixed to a wall and which includes a hollow backing member;

a mounting means engaging means securely affixed to said housing and which is releasably received in said hollow backing member to releasably mount said housing onto a wall; and ledge means on said housing for mounting a razor between uses of such razor;

said improvement further including side members attached to said housing front and which have holes defined therein, said improvement further including tabs on said housing sides which are accommodated in said side member holes to attach said housing front to said housing sides.

2. The improvement defined in claim 1 wherein said hollow backing member includes a guide means and said engaging means includes an elongate tongue.

3. The improvement defined in claim 1 wherein said ledge means includes an arcuate section.

4. The improvement defined in claim 1 wherein said housing front is unitary.

5. An improvement in a device for dispensing disposable razors, the device comprising:

a housing having a back, sides and a front, said front having an elongate slot defined therein for slidably accommodating disposable razors in a stacked configuration;

a retainer shelf mounted on said back to be located adjacent said slot, said shelf being positioned to support a disposable razor thereon while such razor is accommodated in said slot;

dispensing slot defining means on said retainer shelf for guiding disposable razors out of said elongate slot and out of said housing;

said housing front, sides and back defining a chamber in which the heads of disposable razors are positioned so that the handles of such disposable razors extend outwardly of said chamber through said elongate slot into an orientation wherein said handles can be grasped for moving a disposable razor through said elongate and dispensing slots;

the improvement comprising:

a mounting means which is securely affixed to a wall and which includes a hollow backing member;

a mounting means engaging means securely affixed to said housing and which is releasably received in said hollow backing member to releasably mount said housing onto a wall; and ledge means on said housing for mounting a razor between uses of such razoer, said ledge means including attaching means releasably mounting said ledge means on said housing, said attaching means including tabs on said housing sides which are received in holes in said ledge means.

* * * * *